US009480988B2

(12) United States Patent
Schwelling

(10) Patent No.: US 9,480,988 B2
(45) Date of Patent: Nov. 1, 2016

(54) SHREDDER

(71) Applicant: Hermann Schwelling, Salem (DE)
(72) Inventor: Hermann Schwelling, Salem (DE)

( * ) Notice: Subject to any disclaimer, the term of this patent is extended or adjusted under 35 U.S.C. 154(b) by 415 days.

(21) Appl. No.: 14/162,330

(22) Filed: Jan. 23, 2014

(65) Prior Publication Data

US 2014/0231558 A1 Aug. 21, 2014

(30) Foreign Application Priority Data

Jan. 26, 2013 (DE) ..... 10 2013 001 260

(51) Int. Cl.

| | |
|---|---|
| ***B02C 25/00*** | (2006.01) |
| ***B02C 18/00*** | (2006.01) |
| ***B02C 18/22*** | (2006.01) |
| *B02C 18/16* | (2006.01) |

(52) U.S. Cl.

CPC ..... *B02C 18/0007* (2013.01); *B02C 18/2291* (2013.01); *B02C 25/00* (2013.01); *B02C 2018/164* (2013.01)

(58) Field of Classification Search

CPC ..... B02C 25/00; B02C 18/0007; B02C 18/2291; B02C 2018/164

USPC ..... 241/100, 236, 36

See application file for complete search history.

(56) References Cited

U.S. PATENT DOCUMENTS

| | | | |
|---|---|---|---|
| 4,982,907 | A | 1/1991 | Sedgwick et al. |
| 5,167,374 | A | 12/1992 | Strohmeyer |
| 5,494,229 | A | 2/1996 | Rokos et al. |
| 5,772,129 | A | 6/1998 | Nishio et al. |
| 6,561,444 | B1 | 5/2003 | Yokomine et al. |
| 7,311,276 | B2 | 12/2007 | Matlin et al. |
| 7,490,786 | B2 | 2/2009 | Matlin et al. |
| 7,624,938 | B2 | 12/2009 | Aries et al. |
| 7,631,822 | B2 | 12/2009 | Matlin et al. |
| 7,631,823 | B2 | 12/2009 | Matlin et al. |
| 7,631,824 | B2 | 12/2009 | Matlin et al. |
| 7,635,102 | B2 | 12/2009 | Matlin et al. |
| 7,661,614 | B2 | 2/2010 | Matlin |
| 7,712,688 | B2 | 5/2010 | Priester |
| 7,712,689 | B2 | 5/2010 | Matlin et al. |
| 7,739,934 | B2 | 6/2010 | Tetelbaum et al. |
| 7,798,435 | B2 | 9/2010 | Matlin |

(Continued)

FOREIGN PATENT DOCUMENTS

| | | | |
|---|---|---|---|
| DE | 202006012363 | | 11/2007 |
| DE | 102007020222 | A1 | 10/2008 |
| EP | 1177832 | A1 | 2/2001 |
| GB | 1199903 | A | 7/1970 |
| JP | 57070445 | | 10/1955 |
| JP | 1167130 | A | 6/1989 |
| JP | 5317739 | A | 3/1993 |
| JP | 05092144 | A | 4/1993 |
| JP | 07299377 | A | 11/1995 |
| JP | 8108088 | A | 4/1996 |
| JP | 8164343 | A | 6/1996 |
| JP | 2002239405 | A | 8/2002 |
| JP | 2006204035 | A | 8/2006 |
| WO | 9961154 | A1 | 12/1999 |
| WO | 2005070553 | A1 | 8/2005 |

OTHER PUBLICATIONS

European Patent Office, European Search Report for European Application No. 14152035.3, Jun. 4, 2014, 5 pages.

*Primary Examiner* — Mark Rosenbaum
(74) *Attorney, Agent, or Firm* — Kolisch Hartwell, P.C.

(57) ABSTRACT

The invention relates to a shredder/document shredder for sheet-shaped material, such as paper and material of the like or similar data storage media, having a thickness sensor which protrudes at least partially into a receiving slot. According to the invention, the thickness sensor does not change its position if too much material to be shredded (for example, paper) passes into the receiving slot, but rather pivots about its rotational axis as a result of the friction with the material. A switch is actuated by way of the pivoting movement, as a result of which the electric drive of the shredder is interrupted.

20 Claims, 1 Drawing Sheet

(56) References Cited

U.S. PATENT DOCUMENTS

| | | | |
|---|---|---|---|
| 7,946,514 | B2 | 5/2011 | Matlin et al. |
| 7,946,515 | B2 | 5/2011 | Matlin et al. |
| 7,954,737 | B2 | 6/2011 | Matlin et al. |
| 7,963,468 | B2 | 6/2011 | Matlin et al. |
| 2006/0219827 | A1 | 10/2006 | Matlin et al. |
| 2007/0246582 | A1 | 10/2007 | Aries et al. |
| 2010/0320299 | A1 | 12/2010 | Matlin et al. |
| 2011/0290924 | A1* | 12/2011 | Romanovich ..... B02C 18/0007 241/36 |
| 2011/0297770 | A1* | 12/2011 | Matlin ..... B02C 18/0007 241/36 |

* cited by examiner

SHREDDER

CROSS-REFERENCE TO RELATED APPLICATIONS

This application claims priority to German Patent Application No. 102013001260.0, entitled SHREDDER.

BACKGROUND OF THE DISCLOSURE

The disclosures of all publications referenced herein are incorporated by reference in their entirety for all purposes.

Advantages of the present disclosure will be more readily understood after considering the drawings and the Detailed Description. The drawings illustrate embodiments and schematic concepts for a shredder according to the invention. The purpose of these drawing is to aid in explaining the principles of the invention. Thus, the drawings should not be considered as limiting the scope of the invention to the embodiments and schematic concepts shown therein. Other embodiments of a shredder may be created which follow the principles of the invention as taught herein, and these other embodiments are intended to be included within the scope of patent protection.

While embodiments of a shredder have been particularly shown and described, many variations may be made therein. This disclosure may include one or more independent or interdependent embodiments directed to various combinations of features, functions, elements and/or properties. Other combinations and sub-combinations of features, functions, elements and/or properties may be claimed later in a related application. Such variations, whether they are directed to different combinations or directed to the same combinations, whether different, broader, narrower or equal in scope, are also regarded as included within the subject matter of the present disclosure. Accordingly, the foregoing embodiments are illustrative, and no single feature or element, or combination thereof, is essential to all possible combinations that may be claimed in this or a later application.

It is believed that the disclosure set forth herein encompasses multiple distinct inventions with independent utility. While each of these inventions has been disclosed in its preferred form, the specific embodiments thereof as disclosed and illustrated herein are not to be considered in a limiting sense as numerous variations are possible. Each example defines an embodiment disclosed in the foregoing disclosure, but any one example does not necessarily encompass all features or combinations that may be eventually claimed. Where the description recites "a" or "a first" element or the equivalent thereof, such description includes one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically stated.

I. Field of Application

The invention relates to a shredder/document shredder for sheet-shaped material, such as paper and material of the like or similar data storage media, according to the precharacterizing clause of Claim 1.

II. Technical Background

DE 10 2007 020 222 A1 has disclosed a shredder which has a cylindrical roller which protrudes into the receiving slot for the material to be shredded. The roller is mounted rotatably on a pivotable fork and a spring acts on the fork in such a way that the roller assumes a defined position in the receiving slot. If too much material to be shredded is then fed to the receiving slot, the roller and therefore also the fork are displaced away from the slot region. During this movement, a switch is actuated which then stops the electric motor for the cutting unit. The cylindrical roller and the opposite side of the receiving slot act here to a certain extent as thickness sensor, in order to prevent overloading of the cutting unit and/or the electric motor.

Document US 2006/0219827 A1 describes thickness sensors which can be moved in a translational or else rotational manner and protrude into the receiving slot. It is once again also the case here, as in the abovementioned prior art, that the gap in the receiving slot changes depending on the quantity of the material to be shredded, for example paper.

It is also the case in document US 2010/0320299 A1 that a thickness sensor acts which is of cylindrical configuration and protrudes with part of its circumferential face into the receiving slot of a shredder. Said cylinder is mounted eccentrically and is held in its rest position by means of a tension spring. If too much paper is then introduced there into the receiving slot, friction occurs between the paper and the cylinder, as a result of which said cylinder pivots into the receiving slot (to a certain extent forms a wedge) and the paper feed is blocked as a result.

A common feature of the document shredders according to the prior art is that the receiving slot has a variable width in the region of the thickness sensor. In one case, an additional pivoting mechanism is required, in order to guide a roller of the thickness sensor out of the receiving slot, whereas, in the other case, the slot is narrowed further if too much paper is in the receiving slot. Great forces occur here between the thickness sensor and the cutting unit because the cutting unit still continues to pull on the paper on account of its stopping time, while said paper is already blocked at the thickness sensor.

III. SUMMARY OF THE INVENTION

Technical Problem

Proceeding from the abovementioned facts, it is therefore a problem of the invention to find a shredder/document shredder with a switching unit and/or a switching unit for a shredder/document shredder which at least reduces the disadvantages from the cited prior art.

Solution of the Problem

The problem is solved by way of a shredder having the features of Patent Claim 1. The dependent patent claims disclose preferred design variants of the invention.

The switching unit of the shredder according to the invention contains at least one sensor (thickness sensor) which senses (in the sense of tests) the thickness of the supplied stack of sheet-shaped material, and a means which actuates a circuit breaker in the case of a threshold value which is set being exceeded, which circuit breaker interrupts the current circuit for the drive of the cutting unit of the shredder or sends a switching signal to a control unit of the shredder, whereupon the control unit communicates with the drive of the shredder.

The subject matter of the invention differs, in particular, from the prior art in that the thickness sensor firstly does not pivot out of the receiving slot, for example if too much paper is fed in, but rather merely rotates concentrically about its longitudinal axis by a small amount, as a result of which a switch is actuated which in turn forwards the corresponding signal to a controller of the shredder or actuates the circuit breaker or is said circuit breaker in itself.

According to the invention, the thickness sensor is also not pulled further into the receiving slot as a result of the frictional forces between the sheet-shaped material (for example, paper) which is fed in and said thickness sensor, as a result of which tensile stresses cannot occur between the thickness sensor and the cutting unit, as is the case in the known solutions, for example according to US 2006/0219827 A1.

Because the thickness sensor according to the invention pivots merely about its longitudinal axis in order to generate a switching signal or switching movement, few components are required for the thickness sensor and, in addition, the entire construction can be of more stable construction overall. A further advantage is simple components for the thickness sensor per se and for the electric/electronic switching unit which is coupled to the thickness sensor, which components can be produced and mounted with low outlay in comparison with the solutions according to the prior art.

In particular, the invention permits the use of simple switches in the electric/electronic switching circuit and/or current circuit of the shredder. This becomes possible, since the limit value for the maximum number of sheets of the material which is fed in is defined by the spacing between the active and the passive part of the thickness sensor, what is known as the gap, in more precise terms the gap thickness. Although merely simple switches without high requirements with respect to their switching accuracy are used, high testing accuracy can be achieved by way of the thickness sensor according to the invention. In addition, the process reliability is also improved, since fluttering/oscillation of the material which has already been gripped and pulled by the cutting unit has only very small effects or no longer any effects on the sensor elements of the thickness sensor.

Preferred design variants of the invention are the subjects having the features of at least one of Patent Claims 2 to 13.

EXEMPLARY EMBODIMENTS

The invention will be explained further and in detail using preferred exemplary embodiments which do not, however, restrict the invention and are shown diagrammatically in drawings, in which.

Figure 1:
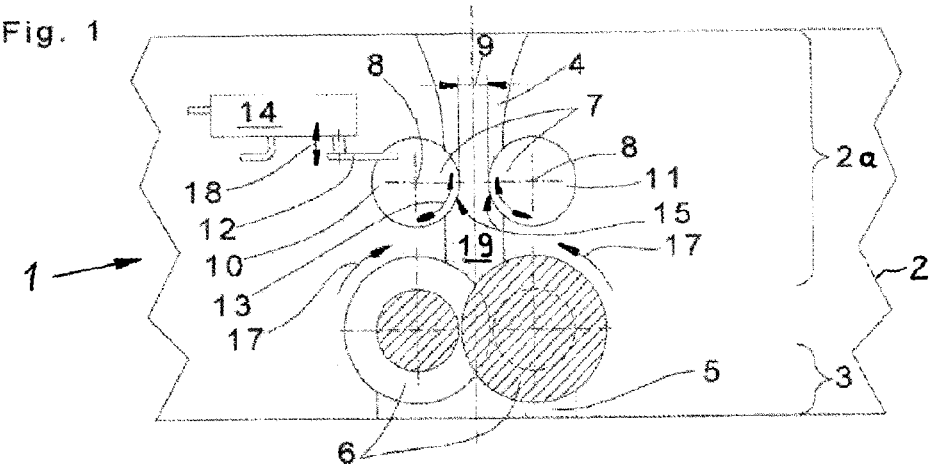
FIG. 1 shows a first refinement of the shredder according to the invention.

It is to be assumed for the following explanations that terms such as "top", "bottom", "left" and "right" relate only to the respective illustration in the figures, and that the actual arrangements can differ from said terms. The dimensions of the real components can also differ from the dimensions in the figures. Furthermore, it is emphasized that identical components in the different figures are always provided with the same reference numerals; they also have in each case the same meaning, even if they are not mentioned expressly with respect to each figure in the description of the design variants.

Of the shredder/document shredder according to the invention, FIG. 1 shows only the module, in which the subject matter of the invention is arranged, the cutting unit 1 including housing as detail, with a view into the interior. The cutting unit 1 comprises a cutting roller pair 6. An associated gear mechanism, an electric motor and a controller have been omitted in this illustration. However, said components of a shredder are known per se from the prior art.

From a top side of the housing 2 of the cutting unit 1, the material to be shredded (for example, a plurality of sheets of sheet-shaped paper) is fed via a receiving slot 4 to the cutting roller pair 6. The receiving slot 4 extends from the top side of the housing 2 essentially as far down as the intake region 19 of the cutting roller pair 6.

The cutting rollers 6 can be configured in such a way that they are constructed from cylinder sections which mesh with one another and, as a result, produce paper strips, or they can also additionally be provided with a structured surface, with the result that they shred the paper strips further lengthwise.

The shredded material then leaves the cutting roller pair 6 in the lower section 3 of the housing of the cutting unit 1 and falls into the collecting container (likewise not shown).

In order that a shredder cannot be overloaded, it is equipped with a switching unit according to the invention, with a thickness sensor 7 here which is assigned principally to the controller of the shredder.

In the first design variant which is shown in FIG. 1, the novel switching unit, the thickness sensor 7, consists of two cylinders which are arranged parallel to one another and at a spacing from one another, are mounted such that they can be rotated about a longitudinal axis 8 and protrude with a section of their circumferential face into the receiving slot 4.

As a result, a gap 9 is formed between the two cylinders, the thickness of which gap 9 is substantially constant independently of the rotational position of the cylinders. In addition, said gap 9 is an equivalent for the designed performance of the shredder, that is to say for the maximum possible number of sheets which may be fed to the cutting roller pair 6.

The left-hand cylinder of the thickness sensor 7 is the active part 10 because it acts on a switch 14 by means of a cam or lever 12 in the case of a rotational pivoting movement 13. The switch 14 can be configured both as a closing contact and as an opening contact of a current circuit or an electric/electronic control circuit.

That part of the thickness sensor which lies opposite the active part 10 of the thickness sensor 7 is the passive part 11. This name has been selected because the part 11 does not forward any information to a controller or an electric motor and merely assists the further sliding of the material to be shredded. In the case of the thickness sensor 7 of a first design, its passive part 11 is likewise arranged in a rotational pivotably movable manner.

If, for example, too much paper is then fed via the receiving slot 4 past the thickness sensor 7, that is to say a greater number of sheets of paper than the maximum number of sheets defined in the operating instructions of the shredder, frictional forces occur between the paper and the active part 10, that is to say a section of its circumferential face, and the passive part 11, that is to say a section of its circumferential face, and the cylinders begin to rotate. The active part 10 of the thickness sensor 7 then actuates the switch 14. If the switch 14 has switched off the drive motor of the cutting unit 1, either directly or else indirectly via a controller, the material to be shredded (for example, paper) can be pulled out of the receiving slot 4.

If the signal of the switch 14 is not guided by a controller, the motor could start up again immediately in the case of a pivoting movement 13 of the thickness sensor 7 in the opposite direction. For this reason, it is advantageous if the signal of the switch 14 runs via a controller and the cutting operation is restarted via a starting command only after removal of the excessively thick paper bundle and a reduction of the paper bundle.

Figure 2:
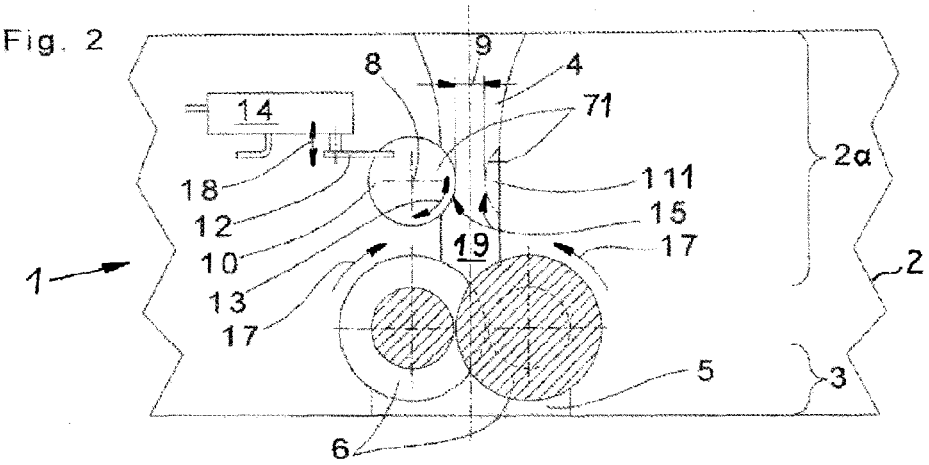
FIG. 2 shows a second refinement of the shredder according to the invention.

The preferred second exemplary embodiment according to FIG. 2 is substantially identical to the subject matter according to FIG. 1, but the right-hand, rotating passive cylinder 11 has been dispensed with in the thickness sensor 71 of a second design/refinement which is used here. Instead of said cylinder 11, the wall face of the receiving slot 4 can be provided with a bead which extends perpendicularly with respect to the plane of the image, for example of a circular section 111 as viewed in cross section. Instead of said bead 111, however, the flat face of the receiving slot 4 can also extend. A downwardly widening wedge is also conceivable. It is decisive for the invention merely that the gap 9 is constant over the entire length of the receiving slot 4, that is to say perpendicularly with respect to the plane of the image.

Figure 3:
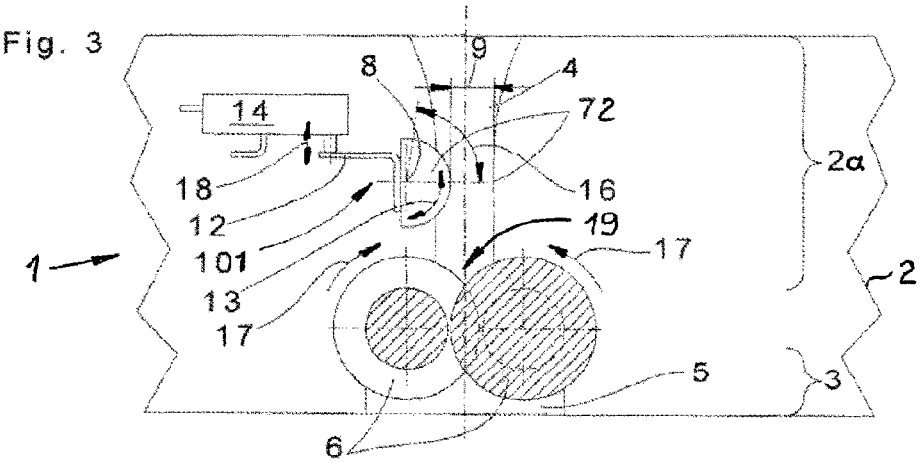
FIG. 3 shows a third refinement of the shredder according to the invention.

The preferred third design variant of the invention according to FIG. 3 once again has a small difference from the subject matter according to FIG. 2. Here, the active part of a second design 101 of the thickness sensor 72 of a third design is no longer shown, that is to say provided, as a complete cylinder. Since the active part 101 performs only a small pivoting movement 13, a complete circular cross section is not required. An angle 16 indicates that only a small circumferential region 16 of the active part of a second design 101 is required, in order to realize the complete function of the thickness sensor 72 of a third design.

According to the invention, instead of the switch 14, a twisting element in the active part 10 or active part of a second design 101 is also conceivable, which twisting element actuates the switch 14 in the case of a corresponding torque.

According to the invention, however, measures are also conceivable which increase the friction between the active part 10 or the active part of a second design 101 and the material to be shredded (for example, paper). For instance, the cylinder surface 15 can be roughened, for example. In a further variant, the cylinder surface 15 can also be provided with a rubber-like layer, it being possible for said layer to consist of a shrunk-on tube, or else an adhesively bonded strip. In a further refinement of the cylinder surface 15, said cylinder surface 15 can be provided with longitudinal grooves. It is also conceivable that the cylinder surface 15 is provided with spikes.

In order that the active part 10 or the active part of a second design 101 of the thickness sensor 7, 71 or 72 is in the correct starting position again after deactivation of the shredder, said active part can be moved into position by way of a restoring force of the switch 14 according to the invention.

In a further refinement of the invention, the restoring force of the switch 14 and/or a restoring element which acts on the active part 10 or 101 are/is of adjustable configuration. Said restoring element or the restoring moment which results therefrom can be arranged concentrically with respect to the longitudinal axis 8 of the active part 10 or the active part of a second design 101.

Furthermore, individual features or methods of operation which are described in conjunction with the figures can represent an independent invention when taken on their own. The applicant therefore reserves the right to also claim further features of a significance which is essential to the invention which have previously been disclosed only in the description, in particular in conjunction with the figures. The patent claims which are submitted with the application are therefore merely formulation proposals without prejudice for the achievement of patent protection which goes further.

One preferred design variant which is not shown but lies within the scope of the claimed invention can consist in that a further sensor is arranged in the receiving slot 4 below the thickness sensor 7 and in front of the intake region 19. Said sensor is provided for switching on the cutting unit. If supplied material (paper) is present in the said region, the sensor generates a switching-on signal for the cutting unit. If the material passes the sensor and no further material follows it, a further signal is generated for switching off the cutting unit. Said further signal is coupled in terms of circuit technology to the thickness sensor in such a way that a signal from the thickness sensor which corresponds to too much supplied paper blocks the further sensor, with the result that switching on of the cutting unit is not possible in a circumstance of this kind.

A further preferred design variant which is not shown but lies within the scope of the claimed invention can consist in that the passive element of the thickness sensor is mounted eccentrically, and therefore the gap, that is to say its thickness, can be set in a simple way to the different limit values for paper quantities/stack thicknesses of the different security levels and cutting widths of the shredder/document shredder. As a result, the degree of repeated parts in the manufacturing process of the shredders can also be increased and the manufacturing costs can therefore be lowered.

One design variant of the invention which is not shown is that the switching unit according to the invention is arranged in a receiving slot of a cutting unit of a document shredder/shredder, which receiving slot is provided for feeding in data storage media in the form of DVDs, CD-ROMs, diskettes or flat data storage media of this type.

LIST OF REFERENCE NUMERALS

1 Cutting unit
2 Housing
**2*a* Upper section (of item 2**)
3 Lower section (of item 2)
4 Receiving slot
5 Outlet opening (on or of item 6)
6 Cutting roller pair
7 Thickness sensor (first design/refinement)
  71 Thickness sensor (second design/refinement)
  72 Thickness sensor (third design/refinement)
8 Longitudinal axis
9 Gap (gap thickness)
10 Active part of the thickness sensor (pivotably movable, rotational)
  101 Active part of the second design of the thickness sensor (pivotably movable, rotational)
11 Passive part of the thickness sensor (pivotably movable, rotational)
  111 Passive part of the thickness sensor (bead; circular section stationary; for item 71)
12 Cam or lever
13 Pivoting movement of the thickness sensor (of item 10)
14 Switch
15 Cylinder face
16 Circumferential region
17 Rotational direction during cutting
18 Switch movement
19 Intake region (inlet region of item 6)

The invention claimed is:

1. A shredder comprising:

a cutting unit at a top of the shredder;

a collecting container below the cutting unit;

an elongate receiving slot extending in an elongation direction and being formed in the cutting unit for receiving material to be shredded;

an outlet opening formed on an underside of the cutting unit for discharging shredded material into the collecting container;

a cutting roller pair which is driven by an electric motor, situated between the receiving slot and the outlet opening;

an intake region formed in the receiving slot, for directing material to be shredded into the cutting roller pair;

a thickness sensor in the intake region, wherein:

the thickness sensor protrudes into the receiving slot, and the thickness sensor is arranged such that the thickness sensor can be rotated about a stationary longitudinal axis which runs parallel to the elongation direction of the receiving slot, and a gap is formed by an active part and a passive part of the thickness sensor, and the gap remains substantially constant in the case of a possible pivoting movement of the active part and/or the passive part.

2. The shredder according to claim 1, wherein the active part of the thickness sensor is configured as a cylinder face including a circumferential section which protrudes into the receiving slot.

3. The shredder according to claim 1, wherein the passive part of the thickness sensor is configured as a rigid, non-rotating face.

4. The shredder according to claim 1, wherein the passive part of the thickness sensor is configured as a cylinder face including a circumferential section which protrudes into the receiving slot.

5. The shredder according to claim 4, wherein a cylinder surface formed as part of the thickness sensor faces the receiving slot and the cylinder surface is equipped with a surface which increases the coefficient of friction between material to be shredded and the active part of the thickness sensor.

6. The shredder according to claim 4, wherein, after removal of excessively thick material, a restoring force of the switch also pivots the active part of the thickness sensor back rotationally.

7. The shredder according to claim 6, wherein a cylinder surface formed as part of the thickness sensor faces the receiving slot and the cylinder surface is equipped with a surface which increases the coefficient of friction between material to be shredded and the active part of the thickness sensor.

8. The shredder according to claim 6, wherein the restoring force of the switch or else a restoring moment in the active part of the thickness sensor is of adjustable configuration.

9. The shredder according to claim 1, wherein the active part of the thickness sensor has a cam or lever which actuates a switch during a pivoting movement of the thickness sensor, as a result of which the cutting unit is deactivated electrically, at least indirectly.

10. The shredder according to claim 9, wherein, after removal of excessively thick material, a restoring force of the switch also pivots the active part of the thickness sensor back rotationally.

11. The shredder according to claim 10, wherein a cylinder surface formed as part of the thickness sensor faces the receiving slot and the cylinder surface is equipped with a surface which increases the coefficient of friction between material to be shredded and the active part of the thickness sensor.

12. The shredder according to claim 10, wherein the restoring force of the switch or else a restoring moment in the active part of the thickness sensor is of adjustable configuration.

13. The shredder according to claim 1, wherein an element is twisted by a pivoting movement of the active part of the thickness sensor, which element actuates a switch and, as a result, the cutting unit is deactivated electrically, at least indirectly.

14. The shredder according to claim 13, wherein, after removal of excessively thick material, a restoring force of the switch also pivots the active part of the thickness sensor back rotationally.

15. The shredder according to claim 14, wherein a cylinder surface formed as part of the thickness sensor faces the receiving slot and the cylinder surface is equipped with a surface which increases the coefficient of friction between material to be shredded and the active part of the thickness sensor.

16. The shredder according to claim 14, wherein the restoring force of the switch or else a restoring moment in the active part of the thickness sensor is of adjustable configuration.

17. The shredder according to claim 1, wherein a cylinder surface formed as part of the thickness sensor faces the receiving slot and the cylinder surface is equipped with a surface which increases the coefficient of friction between material to be shredded and the active part of the thickness sensor.

18. The shredder according to claim 17, characterized in that the cylinder surface is roughened.

19. The shredder according to claim 17, characterized in that the cylinder surface is provided with a rubber-like layer.

20. The shredder according to claim 17, characterized in that the cylinder surface is provided with longitudinal grooves.

* * * * *